US005323504A

United States Patent [19]

McCusker

[11] Patent Number: 5,323,504

[45] Date of Patent: Jun. 28, 1994

[54] DEFORMABLE TOOTHBRUSH

[76] Inventor: Robert M. McCusker, 21 Theodore St., Balmain, New South Wales, Australia, 2041

[21] Appl. No.: 96,847

[22] Filed: Jul. 26, 1993

Related U.S. Application Data

[63] Continuation of Ser. No. 925,291, Aug. 6, 1992, abandoned, which is a continuation of Ser. No. 684,899, May 1, 1991, abandoned.

[51] Int. Cl.[5] ..... A46B 9/04

[52] U.S. Cl. ..... 15/167.1; 15/144.1; 15/172

[58] Field of Search ..... 15/167.1, 172, 144 R, 15/143 R, 106, 110

[56] References Cited

U.S. PATENT DOCUMENTS

| | | | |
|---|---|---|---|
| 651,841 | 6/1900 | Flemming | 15/167.1 |
| 1,327,807 | 1/1920 | Burleigh . | |
| 1,494,448 | 5/1924 | Sookne | 15/167.1 |
| 1,796,001 | 3/1931 | Church | 15/167.1 |
| 2,219,753 | 10/1940 | Seguin | 15/167.1 |
| 2,254,365 | 9/1941 | Griffith et al. | 15/167.1 |
| 2,438,268 | 3/1948 | Bressler | 15/167.1 |
| 2,445,651 | 7/1948 | Weavie . | |
| 2,631,320 | 3/1953 | Bressler . | |
| 3,994,038 | 11/1976 | Moulet . | |
| 4,263,691 | 4/1981 | Paranseree | 15/167.1 |
| 4,403,623 | 9/1983 | Mark . | |
| 4,471,506 | 9/1984 | Massari . | |
| 4,520,526 | 6/1985 | Peters . | |
| 4,712,266 | 2/1987 | Yamaki | 15/172 |
| 4,800,608 | 1/1989 | Key . | |
| 4,829,621 | 5/1989 | Phenegar | 15/167.1 |
| 5,054,154 | 10/1991 | Schiffer et al. | 15/172 |

FOREIGN PATENT DOCUMENTS

| | | | |
|---|---|---|---|
| 3640898 | 1/1988 | Fed. Rep. of Germany . | |
| 2275171 | 1/1976 | France . | |
| WO 88/03772 | 6/1988 | PCT Int'l Appl. . | |
| 8806417 | 9/1988 | PCT Int'l Appl. | 15/167.1 |

*Primary Examiner*—Philip R. Coe
*Assistant Examiner*—Patrick F. Brinson
*Attorney, Agent, or Firm*—Jacobson, Price, Holman & Stern

[57] ABSTRACT

A toothbrush having a head portion (1) which has bristles (2) attached, a handle portion (3) and an intermediate portion (4) of reduced cross-section with regard to the head and handle portions (1), (3). The intermediate portion (4) of the toothbrush is non-resiliently deformable to change the angular relationship between the head portion (1) and the handle portion (2). If this angular relationship is changed after brushing, the user is applying excessive pressure during brushing. The shape of the toothbrush may be changed by the user to suit the user's particular mouth shape.

3 Claims, 2 Drawing Sheets

DEFORMABLE TOOTHBRUSH

This is a continuation of application Ser. No. 07/925,291, filed Aug. 6, 1992, now abandoned; which in turn is a continuation of application Ser. No. 07/684,899, filed May 1, 1991, now abandoned.

TECHNICAL FIELD

This invention relates to toothbrushes and in particular to permanently deformable toothbrushes which "educate" the user to apply the correct pressure to the teeth and gums.

BACKGROUND ART

Recently, several advances have been made in toothbrush design. Among these are what are usually called "angled toothbrushes" which are more convenient for brushing, most especially the back teeth, due to a bend or angle in the brush between the head portion and the handle portion.

Many designers have come up with what they consider to be the "perfect angle" for brushing, however as everyone is an individual, certain angled brushes are better than others depending upon the mouth and teeth of the user.

There are also known in the prior art several types of "resiliently deformable" toothbrushes. These resiliently deformable or flexible toothbrushes may have either a portion of the handle or neck which is resiliently deformable, as disclosed in U.S. Pat. Nos. 1,796,001 and 4,520,526 and International Patent Application No. WO88/06417, or may alternatively have a resilient head portion, as disclosed in several patents including U.S. Pat. No. 1,327,807, 2,445,651, 2,631,320 and 3,994,038.

The alleged advantage of these "resiliently deformable" or "flexible" toothbrushes is that in use, the resilient portion deforms in response to a force applied by the user, there ensuring that the pressure applied to the teeth and gums is the correct pressure to facilitate thorough cleaning without damaging the teeth or gums of the user.

The pressure applied to the teeth and gums by the user of these resilient deformable toothbrushes is, however, a function of the resilient characteristics of the toothbrush, these characteristics being dependent upon the material from which the toothbrush is constructed and the shape of the toothbrush.

Clearly, one such resilient toothbrush, for example, may assist a user to avoid applying exclusive pressure to his or her teeth and gums however, another user of the same toothbrush may not be applying the correct pressure to his or her gums even though it is the same pressure as that applied by the previous user, since a single resiliently deformable toothbrush does not take into consideration the individual characteristics of each user, each toothbrush being limited by its own resilient characteristics.

It can therefore be seen that in order for these resilient toothbrushes to in fact apply the correct pressure for each and every user, the resilient characteristics of each toothbrush must be tailored to suit the particular individual user.

Further, when these resilient type toothbrushes are removed from the mouth, they return to their original undeformed shape thereby giving no indication as to whether or not an excessive pressure was applied to the teeth and gums.

It will be clear to the person skilled in the art therefore that a user could use such a "resiliently deformable" toothbrush under the impression that it is applying the correct pressure to his or her teeth when, in fact, there is no indication whether or not that the particular "resiliently deformable" toothbrush suits that individual. Its use may have applied an excessive pressure to the teeth and gums of the user causing damage.

There are also known toothbrushes in which prior to use a user may select the desired oriententation between the head and the handle, such a toothbrush is described in U.S. Pat. No. 4,829,621. U.S. Pat. No. 4,712,266 discloses a dental whisk in which the head and handle rejoined by a region of reduced cross-sectional area to allow the angle between the head of the whisk. In each of these patents it is the intention of the designer that once the angle between the head and the handle of the brush or whisk is selected it will remain as selected during use even if the user applies excessive brushing pressure. There is no teaching in either patent of the desirability of the angle between the head and the handle of the brush or whisk changing due to the application of excessive brushing pressure.

Clearly there is also a need for a toothbrush the shape of which can be individually matched to the user's mouth, by the user and which will positively indicate to the user that he or she has been applying excessive brushing pressure to his or her teeth.

DISCLOSURE OF THE INVENTION

In accordance with the first aspect, the present invention consists in a toothbrush of integral construction, formed of a synthetic plastics material having a head portion and an elongate handle portion, the head portion having a longitudinal axis and bristles extending substantially perpendicularly to said axis, the head portion and handle portion being joined by an unreinforced intermediate portion which is of smaller cross-sectional area than the adjacent parts of the head portion and of the handle portion, the intermediate portion being non-resiliently deformable without heating to change the angular relationship between the head portion and the handle portion by the application in a user's mouth of brushing pressure producing a bending moment having a magnitude of between 0.04 and 1.1 Newton meters whereby said angular relationship will be changed if a user applies a brushing pressure to the teeth or gums along axes of said bristles of the toothbrush which is over and above that required to clean the teeth and gums efficiently and which produces a bending moment of said magnitude and will remain unchanged on removal of the toothbrush from the user's mouth.

Preferably the bending moment applied to the toothbrush is between 0.2 and 1.0 Newton meters.

The upper and lower limits of the bending moment are set by the requirement that the brush should be capable of applying a proper brushing pressure to the teeth but will bend away under excessive pressure. As used in this specification, and as is generally understood in the art, a toothbrush comprises a handle and a head. The head is an elongate substantially rectangular member having projecting from a planar surface an array of bristles substantially normal to the plane of the surface. The free ends of the array of bristles presents a substantially planar effective brushing surface adapted to contact the teeth. Excessive brushing pressure is indicated when the bristles are caused to bend during brushing so that the teeth and gums are contacted by the sides of the bristles rather than by the effective brushing surface made up of the free ends of the bristles. Obviously the greater the number of the bristles (and therefore the larger the effective brushing surface) and the stiffer the bristles so the greater the force that can be applied to the brush without exceeding the desired brushing pressure on the teeth and gums.

The principal advantage of the present invention over the prior art is that any alteration after brushing of the angle between the head and handle portions of the toothbrush prior to brushing, gives an indication that the user is applying too great a pressure to his/her teeth and gums.

To explain, it will be recognised by those skilled in the art that there is some deflection in a toothbrush when in use, due to the pressure exerted by the user on the teeth, whether the toothbrush is resiliently deformable or not. Any excess pressure over and above that required to clean the teeth and gums effectively, will be detrimental to both the teeth and surrounding gums. When using resiliently deformable toothbrushes of the prior art, the aforementioned deflection disappears upon removal of the toothbrush from the mouth. With the present invention, however, the brush may be non-resiliently deformed by the user prior to insertion into the mouth, the user taking note of the approximate angle between the head and handle portions. After brushing, the toothbrush is removed and a visual comparison between the angle before and after brushing is made, to determine if the pressure exerted by the user on his/her teeth is too large.

In this way, the user is "educated" by trial and error to brush within acceptable limits of pressure on the teeth and gums.

This "education" of the user is in addition to the fact that the toothbrush is deformable prior to insertion into the mouth thereby allowing the user to tailor the shape of the toothbrush to suit his/her particular needs. The user, of course, may simply allow the toothbrush to remain straight before insertion an angle of over 180° being made if brushing is too hard.

BRIEF DESCRIPTION OF DRAWINGS

The invention will now be described in more detail, by way of example only, with reference to the accompanying drawings in which.

BEST MODE FOR CARRYING OUT THE INVENTION

Figure 1:
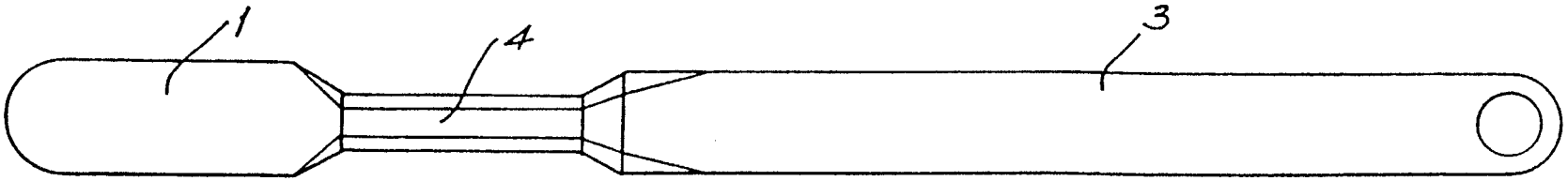
FIGS. 1 and 2 are plan and side elevation views, respectively, of a particular preferred embodiment of the invention, prior to deformation.
Figure 2:
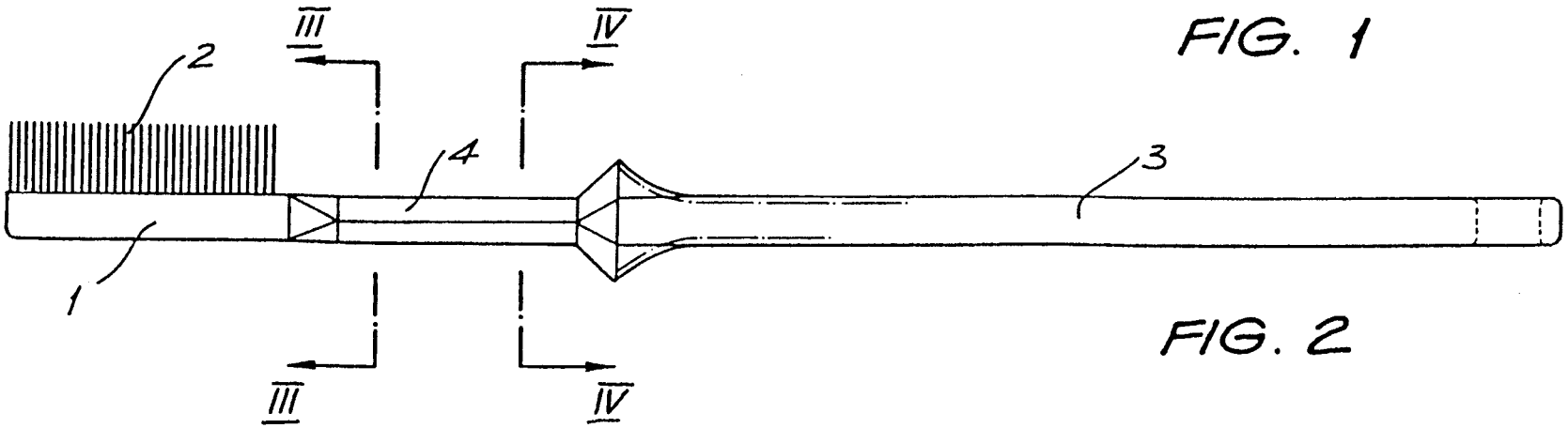
Figure 4:
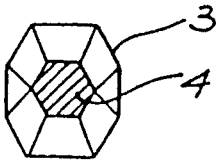
FIGS. 3 and 4 are sectional views through A-A and B-B of FIG. 2.
Figure 3:
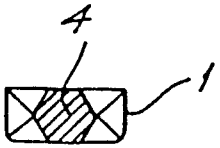

FIGS. 1 and 2 show a toothbrush according to the present invention which comprises a head portion 1 with bristles 2 attached, handle portion 3 and intermediate portion 4. The reduced cross-section of the intermediate portion in relation to the handle and head portions can be clearly seen in FIGS. 3 and 4, the bristles 2 not being shown in FIG. 3.

Figure 5:
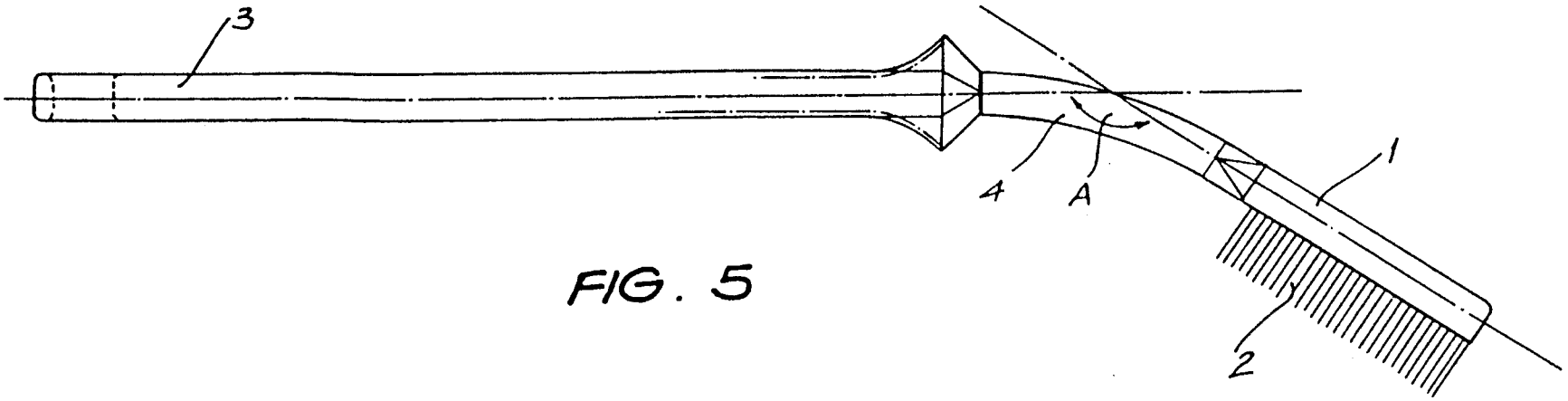
FIG. 5 is a side elevation of the preferred embodiment of the present invention, after deformation but prior to brushing.

In FIG. 5 the toothbrush according to the present invention is shown when it is deformed prior to insertion into the mouth. This initial non-resilient deformation is so that the head to handle portion angle suits the particular user.

The angle is formed by applying a bending moment of between 0.04 and 1.1 Newton meters to the toothbrush. This may be applied to one end of the brush, e.g. the head, while the other end, e.g. the handle, is held stationary and is performed without the application of heat.

The intermediate portion 4 being of the smallest cross-section is deformed non-resiliently, which creates and angle A between the head portion 1 and the handle portion 3, this angle remaining after the bending moment applied to the brush is released due to the non-resilient nature of the toothbrush.

The user may, of course, use the toothbrush completely undeformed, i.e. with the angle A equalling 180°.

The user should take a visual note of this angle A for subsequent comparison with the angle after brushing.

The user now places the brush in the mouth and brushes his/her teeth.

After removal, the user should take note of the angle B between the head portion 1 and the handle portion 3 sustained by the toothbrush even after removal of the force applied to the toothbrush by the user.

If this angle B is greater than angle A, it is clear that the pressure applied to the teeth during brushing is too large.

The user can then, by a trial and error process, learn to apply the correct brushing pressure by applying that pressure which gives adequate cleaning of the teeth and gums yet does not increase the angle between the head and handle portions of the toothbrush.

Figure 6:
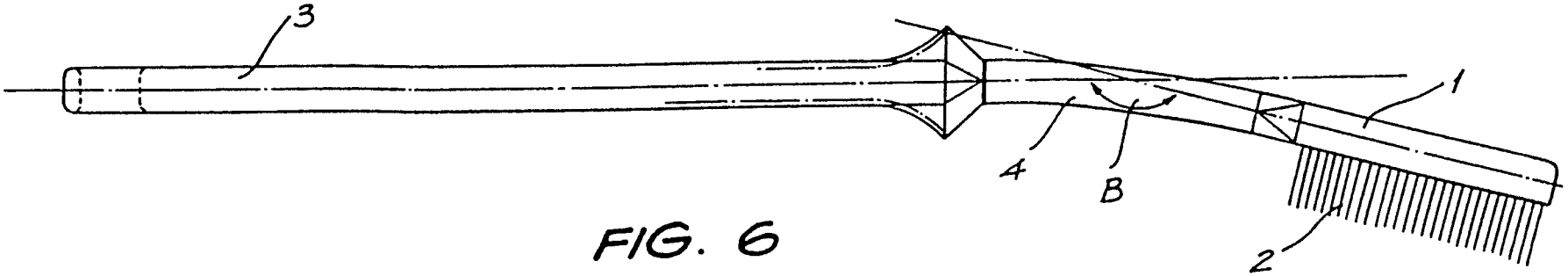
FIG. 6 is a side elevation of the brush in FIG. 5 after incorrect brushing.

In the case of FIG. 6, angle B is clearly greater than angle A in FIG. 5 and therefore the user should reduce the pressure applied to his/her teeth.

If the angle B was equal to angle A, the user should check his/her teeth to ensure adequate cleaning. If the teeth and gums are not adequately cleaned, the user may increase the pressure applied to the teeth but must ensure that when brushing the angle between the head portion and handle portion does not increase from its original angle prior to brushing.

It will be recognised by persons skilled in the art that numerous variations and modifications may be made to the invention as described above without departing from the spirit or scope of the invention as broadly described.

I claim:

1. A toothbrush of integral construction, formed of a synthetic plastics material having a head portion and an elongate handle portion, the head portion having a longitudinal axis and bristles extending substantially perpendicularly to said axis, the head portion and handle portion being joined by an unreinforced intermediate portion which is of smaller cross-sectional area than the adjacent parts of the head portion and of the handle portion, the intermediate portion being non-resiliently deformable without heating to change the angular relationship between the head portion and the handle portion by the application in a user's mouth of brushing pressure producing a bending moment having a magnitude of between 0.04 and 1.1 Newton meters whereby said angular relationship will be changed when a user applies a brushing pressure to the teeth or gums along axes of said bristles which is over and above that required to clean the teeth and gums efficiently and which produces a bending moment of said magnitude and will remain changed on removal of the toothbrush from the user's mouth.

2. A toothbrush as claimed in claim 1 wherein the intermediate portion may be permanently deformed to change the angular relationship between the head portion and the handle portion by the application of a bending moment of between 0.2 and 1.0 Newton meters.

3. A toothbrush as claimed in claim 1 wherein an angle between the head portion and the handle portion prior to brushing of the teeth is less than or equal to 180°.

* * * * *